US008220673B1

(12) United States Patent
Levin et al.

(10) Patent No.: US 8,220,673 B1
(45) Date of Patent: Jul. 17, 2012

(54) CAP CURVER AND WASHER

(75) Inventors: Gregg M. Levin, Boston, MA (US); Guang Yu Gao, Malden, MA (US)

(73) Assignee: Perfect Curve Inc., Boston, MA (US)

( * ) Notice: Subject to any disclaimer, the term of this patent is extended or adjusted under 35 U.S.C. 154(b) by 345 days.

(21) Appl. No.: 12/655,802

(22) Filed: Jan. 8, 2010

(51) Int. Cl.
*D06C 15/00* (2006.01)

(52) U.S. Cl. ..... 223/84; 223/66; 206/8

(58) Field of Classification Search ..... 223/1, 23, 223/24, 61, 66, 84; 206/8
See application file for complete search history.

(56) References Cited

U.S. PATENT DOCUMENTS

| | | | | | |
|---|---|---|---|---|---|
| 2,490,508 | A | * | 12/1949 | Delgatto | 223/23 |
| 4,491,256 | A | * | 1/1985 | Payne et al. | 223/24 |
| 4,607,769 | A | * | 8/1986 | DeLisle et al. | 223/12 |
| 5,074,410 | A | * | 12/1991 | Fries et al. | 206/8 |
| 5,163,589 | A | * | 11/1992 | Biehl | 223/24 |
| 5,172,837 | A | * | 12/1992 | Finney et al. | 223/23 |
| 5,865,333 | A | * | 2/1999 | Wolfe | 206/8 |
| 5,908,146 | A | * | 6/1999 | Levin | 223/84 |
| 6,125,997 | A | * | 10/2000 | Campbell | 206/8 |

* cited by examiner

*Primary Examiner* — Nathan Durham
(74) *Attorney, Agent, or Firm* — William Nitkin

(57) ABSTRACT

A device for retaining a baseball cap during washing or storage having a rear member with a cap crown support portion and a brim support portion. The brim support portion includes a brim receipt area for either curving the brim or maintaining the brim in a flat position. A front member is rotationally attached to the rear member for closing over the front of the cap's crown to retain the cap in its selected position.

4 Claims, 6 Drawing Sheets

CAP CURVER AND WASHER

BACKGROUND OF THE INVENTION

1. Field of the Invention

This invention resides in the field of structures for retaining the shape of baseball-type caps during washing and storage and more particularly relates to a device that can hold the cap brim and crown portion in a desired shape and at the same time allow for selection of whether to bend the brim of the cap to a curved shape or to maintain it in a generally flat shape.

2. Description of the Prior Art

In the prior art it is well known that baseball-type caps, hereinafter referred to as caps, can have their brims either flat or curved, as sold. If a cap is sold with a flat brim, it can be shaped with a desired curve, as described in Applicant's prior U.S. Pat. No. 5,908,146 for a Cap Brim Shaping, Transport and Display Device. This patent is incorporated by reference into this application with regard to the desired shape and structure of baseball caps. It has been found that cap owners not only wish to maintain their cap brims in a desired shape when worn, but also when washing them to keep the brims with such desired curve and to keep the crown portions of the caps in their proper shape as the crown portions often display team logos or emblems on the fronts thereof. The appearance of these logos or emblems, denoting the wearer's support for a particular team, is important to the wearers of such caps. The prior art also includes devices that are used to hold caps in a desired shape for washing, such as U.S. Pat. No. 5,012,531 to Schoonover for a Form Retaining Holder for Visored Cap and U.S. Pat. No. 5,172,837 to Finney, Jr. et al. for a Device for Washing a Ball Cap in a Dish Washer. These devices aid users in washing the caps and keeping them clean as caps frequently become dirty and sweat-stained and the additional stiff lining in both the brim and crown portions of caps, when washed, cause the caps to lose their proper shape without devices to maintain their shapes.

SUMMARY OF THE INVENTION

It is a goal of this invention to provide an improved device for use during washing and storage of a cap, such device providing the user the option of either curving the brim or keeping it flat as well as maintaining the crown portion in its upright position for the best display of logos thereon. To that end the device of this invention has a rear member into which the cap is placed and a front member which is pivot hinged on a portion of the rear member and closes thereover. The rear member has a crown support portion that fits up into the crown portion of the cap immediately behind the crown the portion, supporting the crown portion in it upright position. The rear member also has a brim support portion that fits under the brim of the cap and allows the brim to be manipulated therein for either causing a curvature of the brim, if desired, or the brim can be left in a substantially flat position, once the brim and crown portion of the cap are positioned, as desired, on the rear member. The front member is rotated on the pivot hinge and is closed over the crown portion of the cap and locked in position to retain the crown portion of the cap securely within the device while the cap is being either washed or stored. The cap can be placed on the rear member with the back of the cap pushed into the front portion of the cap or extended outward in an open position, such as the position of the cap when it is being worn. The device not only can be used during washing or storage of the cap, but also can be used to protect the cap while traveling and for displaying the cap.

DESCRIPTION OF THE PREFERRED EMBODIMENT(S)

Figure 1:
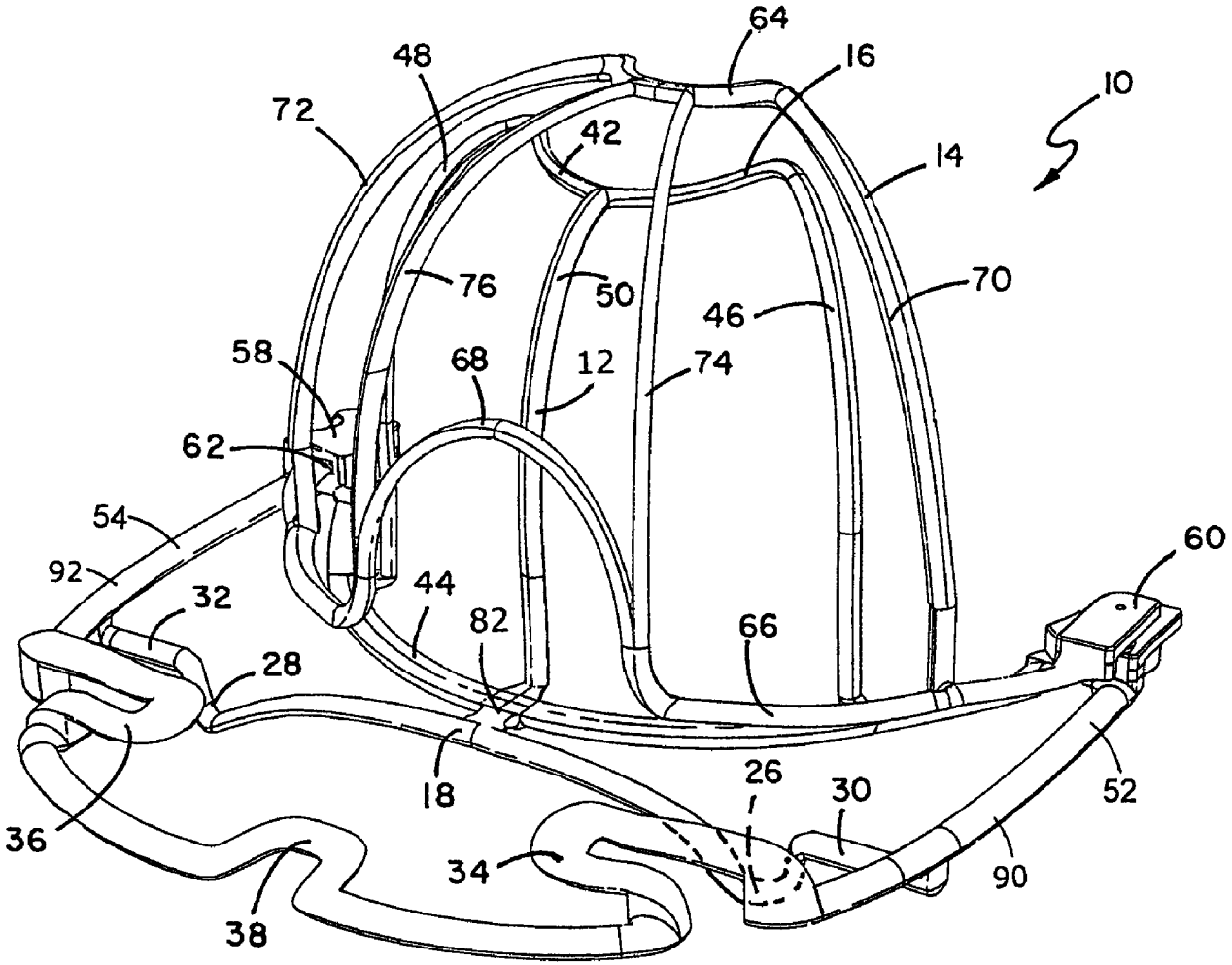
FIG. 1 illustrates a perspective view of the device of this invention in its closed mode, showing the front member closed over the rear member with the cap omitted for better illustration of the device.
Figure 2:
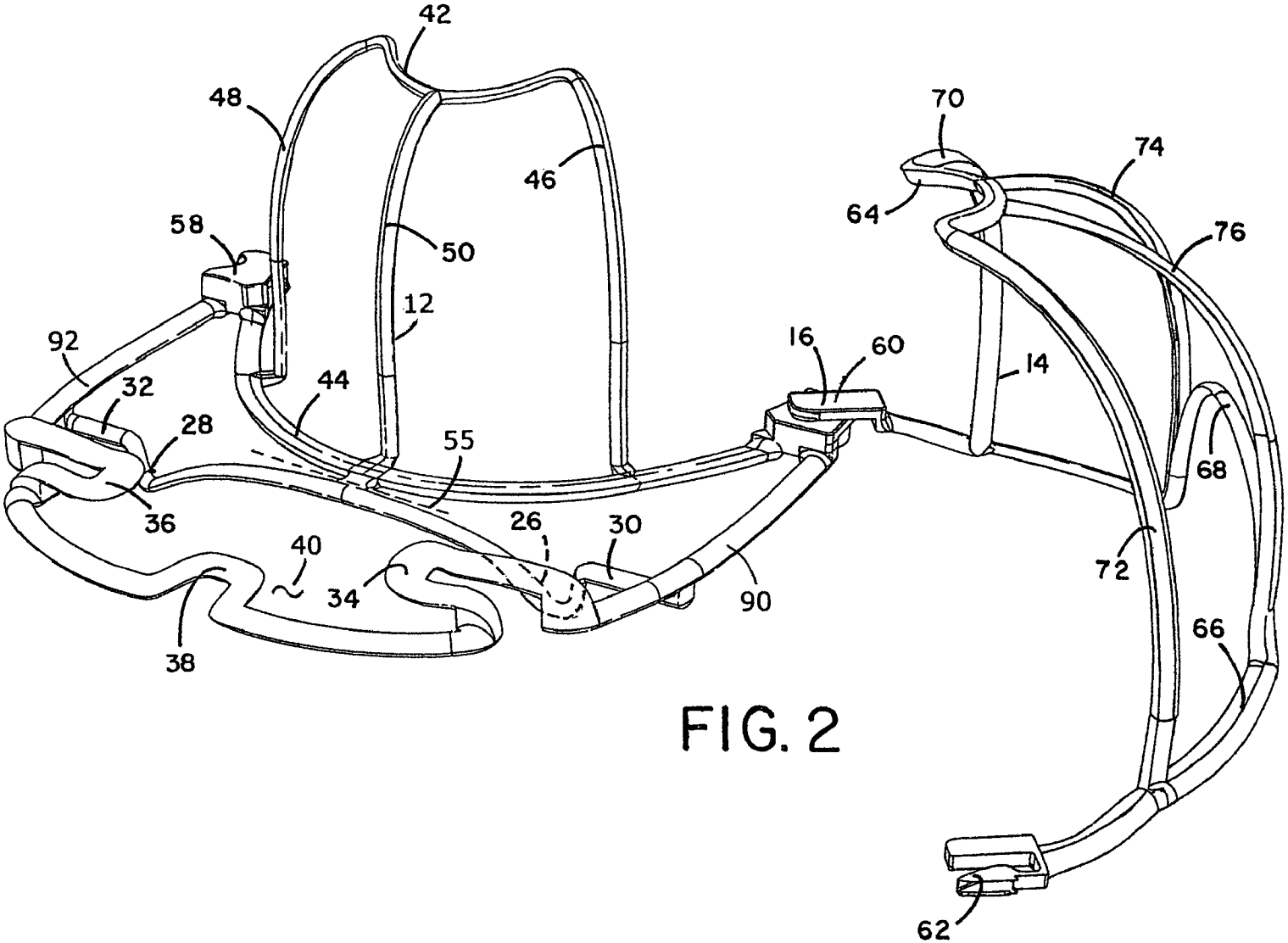
FIG. 2 illustrates a perspective view of the device as seen in FIG. 1, showing the retention front member being rotated on its pivot hinge to an open mode.
Figure 3:
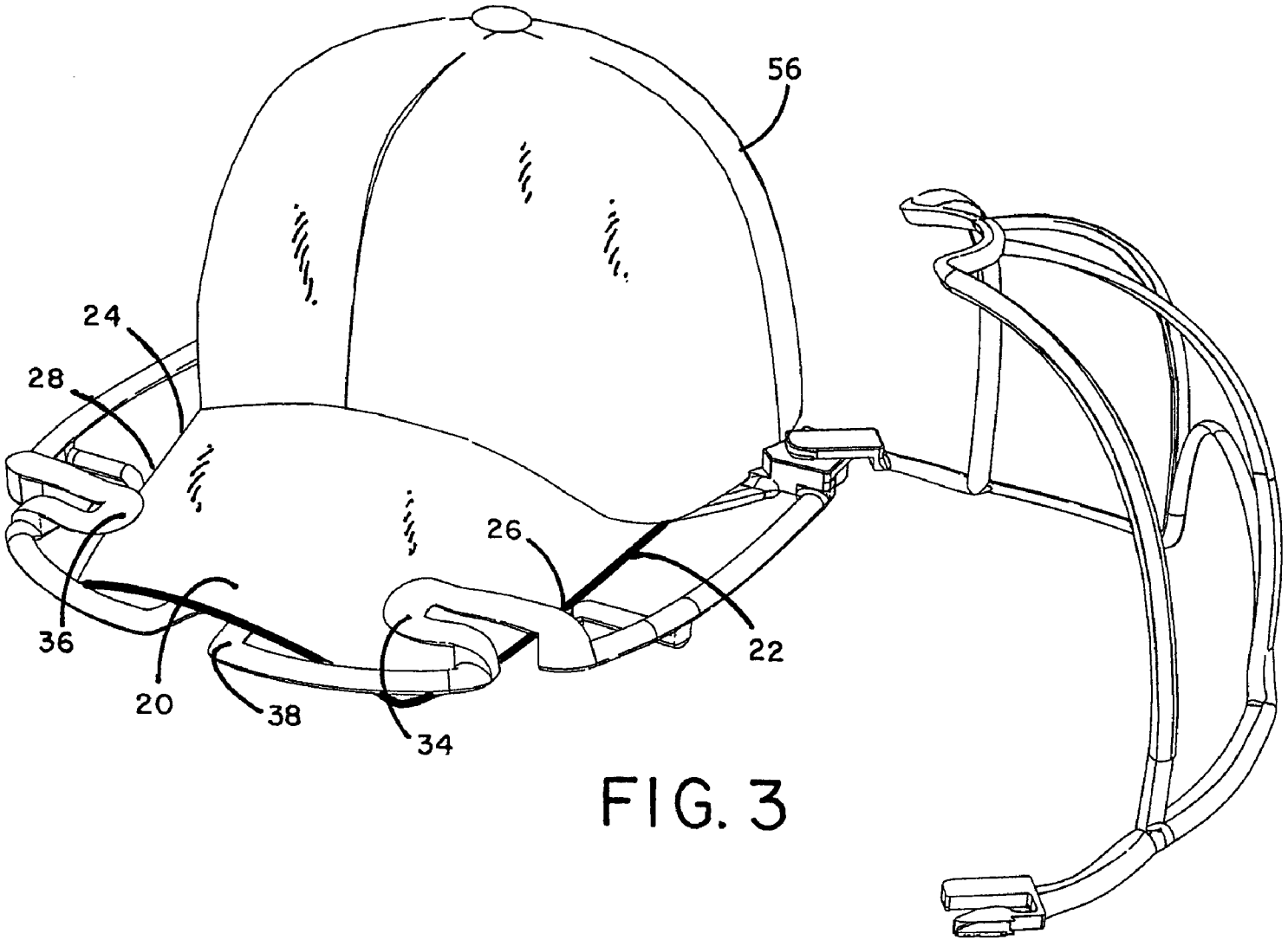
FIG. 3 illustrates a perspective view of the rear member of the device with the cap in place in front of the crown support member, with the cap brim retained in a curved position within the brim retention portion of the rear member and with the retention front member still open.
Figure 4:
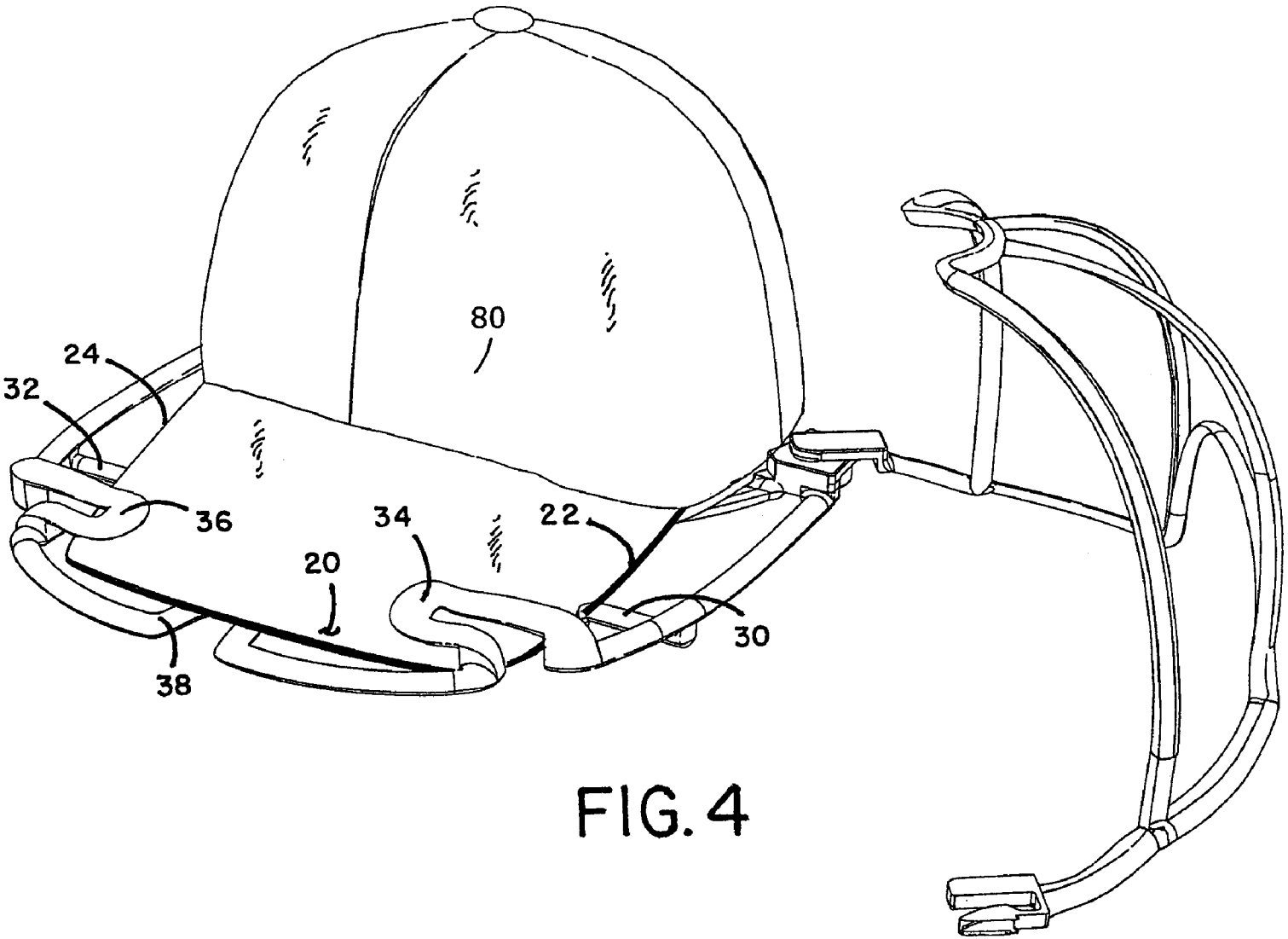
FIG. 4 illustrates a perspective view of the device, as seen in FIG. 3, showing the brim supported on its ends retained in a flat configuration within the brim retention portion of the rear member.
Figure 5:
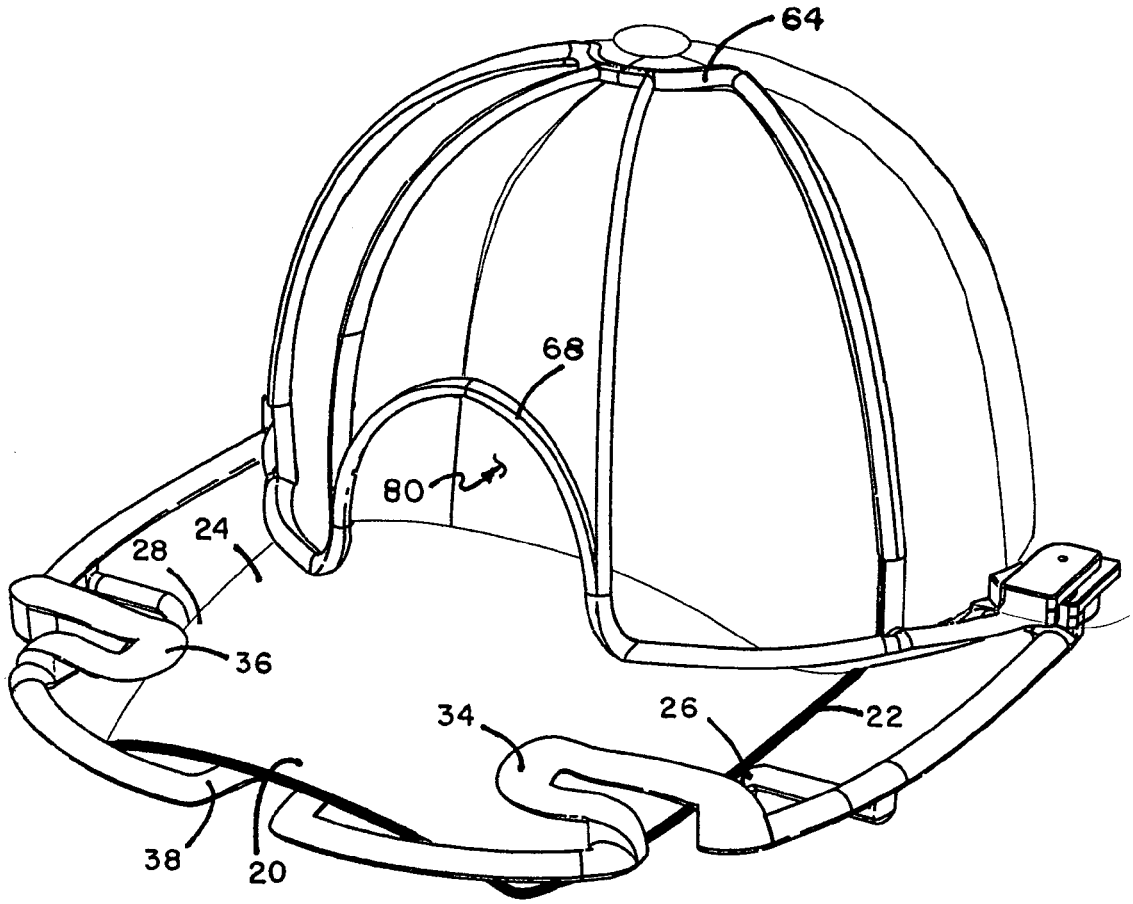
FIG. 5 illustrates a perspective view showing the front member closed over the crown portion of the cap, retaining the brim of the cap in a curved configuration within the brim retention portion.

The device, as shown in FIG. 2, illustrates the device of this invention in its open mode, showing front member 14 rotated open at pivot hinge 60 from rear member 12. Front member 14 is rotationally attached to rear member 12 on pivot hinge 60 and can rotate 180 degrees to close front member 14 over rear member 12, as seen in FIG. 1, so that catch member 62 will catch into latch catch 58 to retain front member 14 closed over the cap, as seen in FIG. 5. The structure of rear member 12 includes a curved lower crown cross member 44 which has extending upwardly therefrom to an upper crown cross member 42, a first outer upright 46 and a second outer upright 48, and in the center of lower crown cross member 44 is inner upright rib 50 which interconnects lower crown cross member 44 to upper crown cross member 42 which upright members and curved lower crown cross member 44 are shaped by being curved in such a way as to fit immediately behind the upright crown portion of the cap, as seen in FIG. 3, to help hold the crown portion in shape while it is either being stored or washed. The brim retention portion 40 of rear member 12 includes a rear brim support 18, the center of which being in a first plane at a first level which is attached at its center by attachment member 82, as seen in FIG. 1, to lower crown cross member 44 and is generally straight and is curved downward in a second plane at a lower level than said first level at each end and further extends laterally on each end to form first brim receipt area 26 and to form second brim receipt area 28 at said lower level. The ends of first brim catch member 30 and second brim catch member 32 are interconnected, respectively, to first extension 90 and second extension 92. The curves in rear brim support 18, as seen in FIG. 1, allow the brim of cap 56 to have its first brim edge 22 placed, if desired, into first brim receipt area 26 and its second brim edge 24 placed within the second brim receipt area 28, as seen in FIG. 5, if one desires to have the brim curved. First brim retention arm 34 extends over first brim edge 22, as seen in FIGS. 2 and 5, to aid in holding it in place within the device, and second brim retention arm 36 extends over second brim edge 24 to aid in holding it in place. Both brim retention arms 34 and 36 are disposed at a level somewhat above said first level. First and second brim retention arms 34 and 36 are connected, respectively, to second ends of first and second support members 52 and 54 which extend from their attachment at their first ends from pivot hinge 60 and catch latch 58. First and second brim retention arms 34 and 36 are further interconnected on their other sides to front brim support 38 positioned at said first level on which the front of cap brim 20 is positioned. Rear brim support 18 also continues through its brim receipt areas 26 and 28 to form horizontally extending first brim catch member 30 at one end and second brim catch member 32 at the other end which extend at said first level, respectively, to first support member 52 and second support member 54 and on which first and second brim catch members 30 and 32, respectively, can be rested first and second brim edge 22 and 24 in the embodiment as seen in FIG. 4 when the brim is to be retained in a flat position.

Figure 6:
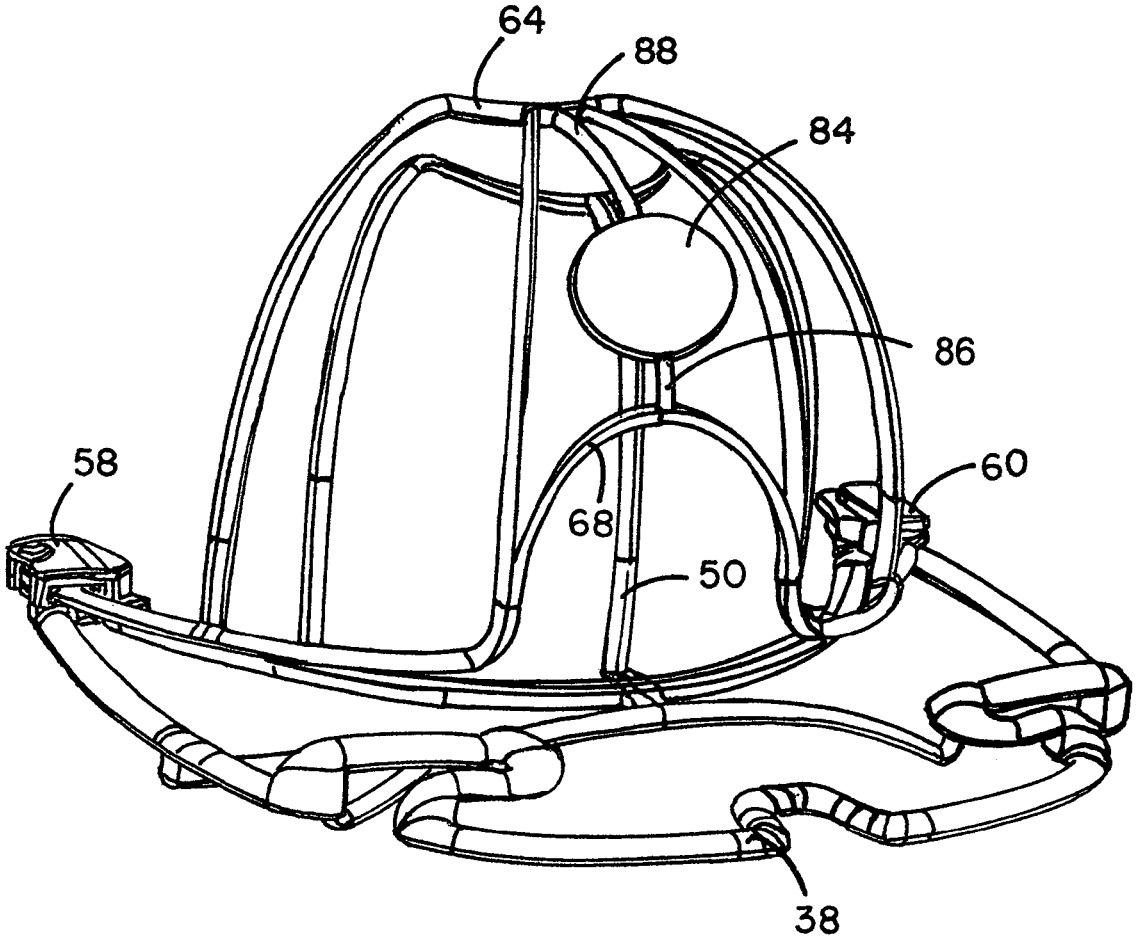
FIG. 6 illustrates a perspective view of the device, showing the embodiment having a planar logo support member.

When the cap is placed on rear member 12 and cap brim 20 is adjusted to be in the desired configuration, either curved or flat within brim retention portion 40, front member 14 is then rotated 180 degree on pivot hinge 60 and closed over rear member 12, sandwiching the crown portion 80 of the cap therebetween. Front member 14 utilizes a crown top member 64 and a crown bottom member 66 interconnected by first crown upright 70 and second crown upright 72 on each side thereof extending between crown bottom member 66 and crown top member 64 and intermediate thereof is a first crown intermediate rib 74 and second crown intermediate rib 76, also interconnecting crown bottom member 66 to crown top member 64 and curved as well in the same fashion as the first and second crown uprights 70 and 72 to be in the general shape of cap crown portion 80. The central portion of crown bottom member 66 forms a crown logo bridge rib 68 that extends upward and over and then downward forming an inverted U-shape which is formed in this fashion to have the logos therebehind and prevent any rib structure from resting on the bottom of the logo or emblem portion of the cap to prevent any marks that might otherwise be formed by a member positioned thereover as well as to better hold that portion of the crown in place while the cap is being stored or washed. In an alternate embodiment, as seen in FIG. 6, a centrally disposed planar logo support member 84 can be positioned and supported between lower central support member 86 extending upwards from the center of crown logo bridge rib 68 and having upper central support member 88 extending from the top thereof. Upper central support member 88 extends to the center of crown top member 64 to support planar logo support member 84. Although planar logo support member 84 is shown as having a round shape, it can be formed in other shapes. Displayed on planar logo support member 84 can be a team logo or other advertising, as desired.

It should be noted that a cap held within the device of this invention can be washed either by hand or in a washing machine or dishwasher. The device allows for the retention of the cap brim in either a curved or uncurved shape while at the same time preserving the curvature and shape of the crown portion of the cap.

The device of this invention can be made of plastic. Although the present invention has been described with reference to particular embodiments, it will be apparent to those skilled in the art that variations and modifications can be substituted therefor without departing from the principles and spirit of the invention.

We claim:

1. A device for retaining a baseball cap during washing or storage, said baseball cap of the type having a crown portion having an inside shape and a brim, said crown portion having a curved shape, a front and said brim having first and second side edges and a front, comprising:

an inner rear member having first and second sides;

a crown support portion defined as part of said inner rear member, said crown support portion having a top and bottom;

a brim support portion defined as part of said inner rear member, said brim support member extending from said bottom of said crown support portion, said brim support portion having a brim receipt area, said brim receipt area having a brim curving portion and a flat brim retention portion for, selectively, either curving the cap brim or keeping it flat;

a front member having first and second sides, said front member being hingeably attached on said first side to said first side of said inner rear member and rotatable over said crown support portion into a closed position to retain said front of said crown portion of said cap;

a catch member defined as part of said front member, said catch member disposed on said second side of said front member for releasably retaining said front member to said second side of said rear member in said closed position when it is desired to retain said crown portion of said cap sandwiched between said inner rear member and said front member:

wherein said rear member further includes:

a curved lower crown cross member having first and second ends and a central portion;

an upper crown cross member;

a plurality of upright curved ribs interconnecting said lower crown cross member to said upper crown cross member, said ribs being bent in the shape of said inside shape of said crown portion of said cap;

said brim receipt area further including:

a rear brim support member having first and second ends, said rear brim support member attached to said lower crown cross member at said central portion thereof, said rear brim support member curving to form first and second curved brim receipt areas, respectively, on said first and second ends thereof, said rear brim support member further extending on said first and second ends thereof to form first and second brim catch members, each having a level, respectively; and first and second support members, each having first and second ends, said first and second support member being attached at their first ends to the ends of said lower crown cross member, each of said first and second brim catch members further extending to said first and second support members;

first and second brim retention arms disposed approximately level, but somewhat above said level of said first and second brim catch members, said first and second brim retention arms being connected, respectively, to said first and second support members; and a front brim support member having first and second ends disposed somewhat lower than said level of said first and second brim retention arms and interconnected at said first and second ends, respectively, to said first and second brim retention arms, said brim support portion for support of said cap in either a first mode with said first and second cap brim edges disposed, respectively, within said first and second brim receipt areas for providing a curvature to said cap brim, and in a second mode when desired with said first and second cap brim edges disposed, respectively, on said first and second brim catch members for retaining said brim in a substantially flat mode above said front brim support member and under said first and second brim retention arms.

2. The device of claim 1 wherein said crown support portion further includes:

a crown bottom portion having a central portion defined in the central part thereof;

a crown top portion;

a plurality of curved crown uprights, each curved in said curved shape of said crown portion of said cap, each of said curved crown uprights having a first end and a second end, said first ends of said curved crown uprights attached to said crown top portion and said second ends of said curved crown uprights attached to said crown bottom portion; and catch means to releasably engage said second side of said front member when closed to catch in said latch for retention of said cap in said device and for the opening of same when desired.

3. The device of claim 2 wherein said central portion of said crown bottom portion is formed in the shape of an inverted U.

4. The device of claim 3 further including a planar logo support member disposed between the top of said inverted U-shaped central portion of said crown bottom and said crown top portion.

* * * * *